US007802705B2

(12) United States Patent
Mitsui

(10) Patent No.: US 7,802,705 B2
(45) Date of Patent: Sep. 28, 2010

(54) METHOD FOR FORMING PLEAT ON FABRIC COMPOSED OF POLYLACTIC ACID YARN, AND PLEATED FABRIC

(75) Inventor: Hisako Mitsui, Yokohama (JP)

(73) Assignee: Magie Pression Co., Ltd., Kanagawa (JP)

( * ) Notice: Subject to any disclaimer, the term of this patent is extended or adjusted under 35 U.S.C. 154(b) by 842 days.

(21) Appl. No.: 11/658,828

(22) PCT Filed: Oct. 12, 2004

(86) PCT No.: PCT/JP2004/015031

§ 371 (c)(1),
(2), (4) Date: Jan. 26, 2007

(87) PCT Pub. No.: WO2006/011246

PCT Pub. Date: Feb. 2, 2006

(65) Prior Publication Data

US 2008/0302837 A1 Dec. 11, 2008

(30) Foreign Application Priority Data

Jul. 29, 2004 (JP) ..... 2004-221393

(51) Int. Cl.
*D05B 35/08* (2006.01)
*D06J 1/12* (2006.01)

(52) U.S. Cl. ..... 223/28; 223/37

(58) Field of Classification Search ..... 223/28–36, 223/37, 38; 38/44; 112/147
See application file for complete search history.

(56) References Cited

U.S. PATENT DOCUMENTS 5,079,867 A * 1/1992 Kober et al. ..... 38/2
5,174,479 A * 12/1992 Dufour ..... 223/37
5,333,765 A * 8/1994 Takizawa ..... 223/28
5,904,277 A * 5/1999 Niedermeyer ..... 223/37
5,996,861 A * 12/1999 Propach ..... 223/37
2005/0203258 A1* 9/2005 Kimura et al. ..... 525/450
2006/0264135 A1* 11/2006 Netravali et al. ..... 442/123

FOREIGN PATENT DOCUMENTS

| | | |
|---|---|---|
| GB | 219685 | 9/1924 |
| JP | 2002-138378 | 5/2002 |
| JP | 2002-212875 | 7/2002 |
| JP | 2002-339227 | 11/2002 |
| JP | 2004-107846 | 4/2004 |
| WO | 00/11255 | 3/2000 |

* cited by examiner

*Primary Examiner*—Ismael Izaguirre
(74) *Attorney, Agent, or Firm*—Fildes & Outland, P.C.

(57) ABSTRACT

A method for forming stable pleats on a fabric composed of a polylactic acid yarn of 100 mass % without causing decrease in physical properties of the polylactic acid yarn includes preparing a fabric composed of a polylactic acid yarn of 100 mass %. The fabric may be a raw fabric such as a woven raw fabric or a sewed product into which a raw fabric is sewed. The sewed product may be one in which part of clothing is sewed, or a final product. The fabric is folded up, and imparted a pressure in the folded state. Specifically, the folded fabric is passed under a suitable line pressure between a pair of rolls whose surfaces are heated in atmospheric ambience. The surface temperature of the rolls is about 100 to 130° C. As described above, a pleated fabric such as pleated clothing whose folded-up portion becomes stable pleats can be obtained.

2 Claims, No Drawings

METHOD FOR FORMING PLEAT ON FABRIC COMPOSED OF POLYLACTIC ACID YARN, AND PLEATED FABRIC

TECHNICAL FIELD

The present invention relates to a method for forming stable pleats on a fabric composed of a polylactic acid yarn.

BACKGROUND ART

Forming pleats on fabrics composed of synthetic yarns such as polyester yarns and nylon yarns is conventionally performed. Methods for forming pleats on fabrics include basically two methods. One method involves folding up a fabric and performing resin treatment on the creases for forming stable creases (pleats). The other method involves folding up a fabric and thereafter imparting heat and pressure thereon in wet heat for forming stable pleats.

In recent years, polylactic acid yarns are given attention as synthetic yarns composing fabrics. The reason is because the polylactic acid yarns are biodegradable. In other words, fabrics composed of polylactic acid yarns have an advantage in that they do not adversely affect global environment even when discarded.

Hence, attempts to employ fabrics composed of polylactic acid yarns for various kinds of clothing are being made and given attention. When they are applied to clothing, it is important that they have superior fashionability, so attempts to form pleats are being made.

Methods for forming pleats include the two methods described above; however, since according to the method using resin, resin is not biodegradable, the advantage of using a biodegradable polylactic acid yarn is weakened; on the other hand, since according to the method imparting pressure in wet heat, polylactic acid is easily hydrolyzable, it has a disadvantage of causing decrease in physical properties of the polylactic acid yarn.

Therefore, Patent Document 1 proposes a method for forming in hot water of about 90° C. pleats on a woven fabric of a polylactic acid yarn intermingled with a hardly hydrolyzable yarn such as a polyester yarn. Specifically, if a woven fabric composed of a polylactic acid yarn of 100 mass % is used, decrease in physical properties of the polylactic acid yarn causes decreases in texture of the whole woven fabric and in strength, so the Patent Document tries to prevent the decreases in texture of the whole woven fabric and in strength by interminglingly weaving the polylactic acid yarn with another kind of synthetic yarn. It also tries to provide a hardly hydrolyzable woven fabric and prevent the decreases in texture of the whole woven fabric and in strength without imparting a high pressure and a high temperature to the polylactic acid yarn by applying a hot water of about 90° C. thereto.

Patent Document 1: Japanese Patent Laid-Open No. 2002-212875 (claim 9 of page 2, and paragraph 0014 of pages 4 to 5)

BACKGROUND ART

Problem to be Solved by the Invention

However, since the method described in Patent Document 1 employs an interminglingly woven fabric of a polylactic acid yarn additionally with a common synthetic yarn such as polyester yarn, the woven fabric is not completely biodegradable. Namely, it has a disadvantage of adversely affecting the biodegradability. Pleated clothing and other items described in Patent Document 1 do not fully make the best use of the function of biodegradability of a polylactic acid yarn.

The present invention is to resolve the disadvantage described above and to provide a method for forming stable pleats on a fabric composed of a polylactic acid yarn of 100 mass % without causing the decrease in physical properties of the polylactic acid yarn.

Disclosure of the Invention

The method of the present invention for forming pleats on a fabric composed of a polylactic acid yarn of 100 mass % basically comprises folding up a fabric (raw fabric, sewed product and the like) and thereafter imparting a pressure thereon in a dry heat environment. The pleated fabric of the present invention woven or knitted of a polylactic acid yarn is equipped with pleats formed in a dry heat environment (100° C. to 130° C.).

EFFECT OF THE INVENTION

The present invention exhibits the effect of being capable of forming stable pleats on a fabric composed of a polylactic acid yarn of 100 mass % having a low melting point and is easily hydrolysable, without decreasing the texture and physical properties thereof. Therefore, the present invention can provide a pleated fabric such as pleated clothing composed of a polylactic acid yarn of 100 mass %, and when the pleated fabric is discarded, the whole pleated fabric is almost completely biodegraded, exhibiting the effect of not adversely affecting the global environment.

BEST MODE FOR CARRYING OUT THE INVENTION

Hereinafter, embodiments of the present invention will be described in detail.

A polylactic acid yarn used in the present invention is obtained by melt spinning a polylactic acid obtained by polycondensating lactic acid. The melting point of a polylactic acid yarn varies depending on the mixing ratio of d- and l-lactic acid, but is generally about 170 to 180° C. A polylactic acid yarn used suitably used in the present invention is "Terramac" (tradename) supplied by Unitika Fibers Ltd.

Then, a fabric composed of the polylactic acid yarn of 100 mass % is prepared. The fabric to be used is a woven raw fabric, knitted raw fabric or nonwoven raw fabric. The woven raw fabric composed of the polylactic acid yarn of 100 mass % is obtained using the polylactic acid yarn for both warp and weft. The knitted raw fabric is knitted using only the polylactic acid yarn. The nonwoven raw fabric is obtained using only the polylactic acid yarn (polylactic acid fibre) as a composing fibre.

During weaving or knitting, for example, sizing to warp yarns or weft yarns, yarns other than polylactic acid yarns are sized ordinarily at a drying temperature of 100° C., but polylactic acid yarns, which have low melting points, are dried at a low temperature of 70° C. The drying in weaving (water jet) is performed also at a low drying temperature of 60 to 70° C.

In the present invention, fabric does not only mean a raw fabric, but includes a fabric into which a raw fabric is sewed. For example, clothing into which a raw fabric is sewed also belongs to the category of fabric in the present invention. Further, half-finished products prior to becoming clothing, specifically sleeves, bodies of garments and the like, also belong to the category of fabric. Therefore, as a fabric composed of a polylactic acid yarn of 100 mass %, a sewed product into which a woven raw fabric is sewed, a sewed product into which a knitted raw fabric is sewed, a sewed product into which a nonwoven raw fabric is sewed and further a sewed product into which the raw fabrics are composited, are used.

Such fabrics are folded up so that desired pleats are formed. The folding-up method is optional. For example, when chevronwise pleats are desired, the fabrics are concertinawise folded up. When chevronwise pleats having various heights (random pleats) are desired, predetermined molds are previously fabricated by folding up paper or the like, and fabrics are folded up after the molds. When gathers and tucks are otherwise desired, the fabrics are folded up after their shapes. The direction of folding up is optional, and may be any of the direction orthogonal to warp yarns, that orthogonal to weft yarns and a bias one.

The fabrics after folded up are imparted a pressure in dry heat. Dry heat mentioned herein means imparting heat without positively imparting moisture or water. Specifically, it generally means imparting heat in atmospheric ambience. The temperature of the dry heat is preferably 100 to 130° C. With the temperature of less than 100° C., there is a tendency that stable pleats are hardly formed. Stable pleats mentioned herein refer to pleats which do not easily wear away even if washed. With the temperature exceeding 130° C., the polylactic acid yarn melts or softens, and texture and strength of the polylactic acid yarn may decrease. Many polylactic acid yarns have a melting point of 170 to 180° C., but since they are pressed together in the present invention, with the temperature exceeding 130° C., the polylactic acid yarn may melt or soften.

Methods of imparting pressure in dry heat include a method in which folded-up portions are ironed. In this case, a temperature of the surface of an iron and a pressure by hand are imparted. The methods also include one in which after a fabric is folded up, it is passed between heating rolls. When heating rolls are used and the surface temperature is 100 to 130° C., the line pressure between the rolls is preferably 0.1 to 1.0 kg/cm. With the line pressure exceeding 1.0 kg/cm, the polylactic acid yarn may melt or soften, and there is a tendency that the fabric is decreased in texture and physical properties. With the line pressure of less than 0.1 kg/cm, the pleats may become unclear. Further, the methods of imparting pressure in dry heat involve one using a hot press machine in sewing work for adhering an interlining cloth or for fitting a sewing product to a mold. In this case, a surface temperature of the hot press machine and a pressure thereby are imparted.

In the pressing process, the pressure must be raised by about 10% depending on the number of raw fabrics piled.

As described above, desired pleats are finally imparted on raw fabrics such as woven fabrics and knitted fabrics, and on fabrics of sewed products into which the raw fabrics are sewed. When pleats are imparted on a raw fabric, if this raw fabric is sewed, a pleated clothing can be obtained. When the present invention is applied to a sewed product of a final product, a pleated clothing can naturally be obtained. Further, when the present invention is applied to a sewed product of a half-finished product, if the residual sewing is completed after pleats are imparted, a pleated clothing can be obtained. Since fabrics in the present invention include, as described before, not only raw fabrics, but sewed products of half-finished and final products, the pleated fabric means both pleated raw fabrics and sewed products.

EXAMPLES

Example 1

A plain weave raw fabric (41 warp yarns/inch, 39 weft yarns/inch; manufactured by Unitika Fibers Ltd.; trade name: Terramac; product number: JTL-002)) woven of a polylactic acid multifilament yarn of 26 decitex/filament was prepared. The woven raw fabric was concertinawise folded up in a bias direction. Then, the fabric was passed between a pair of heating rolls whose surface temperature was heated to 120° C. in a line pressure of 0.25 kg/cm. The treatment was performed in dry heat, specifically in atmospheric ambience and without any moisture imparted. The obtained woven raw fabric had stable pleats formed on folded-up portions, and the pleats did not wear away after being washed.

Example 2

A pleated knitted fabric was obtained as in Example 1, but using a Russel knitted fabric (manufactured by Unitika Fibers Ltd.; trade name; Terramac; product number: SCT-1312) knitted of a polylactic acid multifilament yarn of 84 decitex/36 filaments in place of the plain weave raw fabric used in Example 1. The pleats were stable, and did not wear away after being washed.

Example 3

A pleated fabric was obtained as in Example 1 by using the plain weave raw fabric used in Example 1, holding it between a paper (19-g beet paper) folded up into a predetermined shape and passing them between hot rolls of 80 kg in weight. The temperature of the upper roll was set at 100° C.; the lower roll at 120° C.

The pleats formed in this process were also stable, and did not wear away after being washed.

Reference Example 1

Pleats were formed by holding the raw fabric used in Example 1 between the folded-up paper and passing them between hot rolls as in Example 3. The temperature of the rolls in this case was set at 80° C.

In this experiment, formation of pleats was possible, but the formation of the pleats was weak and when the beet paper was pulled out, the pleats vanished, ending up in a flat raw fabric.

Reference Example 2

Pleats were formed by holding the raw fabric used in Example 1 between the folded-up paper and passing them between hot rolls as in Example 3. The temperature of the rolls in this case was set at 140° C.

In this experiment, when the raw fabric was passed between the hot rolls, it ended up in solidifying, causing breakage of the raw material.

Further, the above experiments were performed using a knitted raw fabric. According to these experiments, pleats were formed on the knitted fabric even if the roll temperature was raised slightly higher, but the temperature of 180° C. or more caused breakage of the raw material.

The invention claimed is:

1. A method for forming a pleat on a folded-up portion of a fabric comprising a polylactic acid yarn of 100 mass %, the method comprising: a step of weaving or knitting the fabric comprising the polylactic acid yarn of 100 mass %; and a step of folding up the fabric and imparting a pressure thereon in a dry heat by heating rolls, wherein, in the step of imparting the pressure on the fabric by the heating rolls in the dry heat, temperatures of the surfaces of the upper and lower rolls of the heating rolls are set at 100 to 130° C., and a line pressure between the upper and lower rolls is set at 0.1 to 1.0 kg/cm; and the fabric is passed between the rotating upper and lower rolls of the heating rolls in atmospheric ambience, and the pleat is thereby formed on the folded-up portion of the fabric by the state of being heated and pressed in the dry heat when the fabric is passed between the heating rolls and the state of being in atmospheric ambience after the fabric has been passed therebetween.

2. A method for forming a pleat on a folded-up portion of a fabric comprising a polylactic acid yarn of 100 mass %, the method comprising: a step of weaving or knitting the fabric comprising the polylactic acid yarn of 100 mass %; and a step of folding up the fabric and imparting a pressure thereon in a dry heat by heating rolls, wherein, in the step of imparting the pressure on the fabric by the heating rolls in the dry heat, temperatures of the surfaces of the upper and lower rolls of the heating rolls are set at 100 to 130° C., and a line pressure between the upper and lower rolls is set at 0.1 to 1.0 kg/cm; and the fabric is passed between the rotating upper and lower rolls of the heating rolls in atmospheric ambience, and the pleat is thereby formed on the folded-up portion of the fabric by the state of being heated and pressed in the dry heat when the fabric is passed between the heating rolls and the state of being in atmospheric ambience after the fabric has been passed therebetween, and further including the step of sewing the fabric into a product.

* * * * *